United States Patent [19]

Zamarco

[11] 4,052,865

[45] Oct. 11, 1977

[54] THREAD-GUIDING MECHANISM FOR FLAT-BED KNITTING MACHINE

[76] Inventor: Gino Zamarco, Via Cavour 11, Somma Lombardo (Varese), Italy, 21019

[21] Appl. No.: 681,590

[22] Filed: Apr. 29, 1976

[30] Foreign Application Priority Data

Apr. 29, 1975 Italy ..... 22832/75

[51] Int. Cl.[2] ..... D04B 15/52

[52] U.S. Cl. ..... 66/128; 66/127

[58] Field of Search ..... 66/127, 128, 129

[56] References Cited

U.S. PATENT DOCUMENTS

| | | | |
|---|---|---|---|
| 2,286,227 | 6/1942 | Ralston | 66/128 |
| 2,602,312 | 7/1952 | Zimic et al. | 66/127 |
| 2,644,323 | 7/1953 | Zimic et al. | 66/127 |
| 2,670,619 | 3/1954 | Zimic et al. | 66/126 R |
| 3,688,525 | 9/1972 | Jeffcoat | 66/125 |

FOREIGN PATENT DOCUMENTS

| | | | |
|---|---|---|---|
| 878,691 | 10/1961 | United Kingdom | 66/128 |

*Primary Examiner*—Ronald Feldbaum
*Attorney, Agent, or Firm*—Karl F. Ross

[57] ABSTRACT

In order to produce an inlay-type pattern on a flat-bed knitting machine, a plurality of thread guides carrying differently colored threads are mounted on respective slides which are movably supported, in pairs, on horizontal guide bars above a needle bed. Each slide coacts with a pair of adjustable stops limiting its reciprocation along the guide bar, another slide taking over the thread feed at the point where a previously active slide is arrested. In order to prevent the thread of the first slide from being engaged by the needles simultaneously with the thread of the second slide, the thread guide of the first slide is swung back from a leading to a trailing position upon reaching the end of its run in one or the other direction; this repositioning of the thread guide is accomplished by a pair of feelers contacting the associated stops. The position of each stop can be changed with the aid of a rack, slidable along the corresponding guide bar, which can be displaced after each machine cycle by a limited number of needle positions according to the pattern to be knitted.

10 Claims, 8 Drawing Figures

PROGRAMMER
57
2
24
41
4
37
59
21
17
62
60
64
63
27
1
7
23
61
58
3
65
9B
20B
9A
20A
R
IV
55
54
56
19
51
50
52

THREAD-GUIDING MECHANISM FOR FLAT-BED KNITTING MACHINE

FIELD OF THE INVENTION

My present invention relates to a knitting machine of the flat-bed type which can be programmed to produce a variety of patterns on a knitted fabric.

BACKGROUND OF THE INVENTION

In such a machine a thread is reciprocated across a needle bed at a speed equaling that of a cam (or set of cams) serving to raise and lower a group of active latch needles successively engaging the thread to form a row of loops known as a course, the number of active needles determining the width of the resulting fabric. The thread or yarn presented to the latch needles trails the tip of a thread guide which is displaced by a transport mechanism synchronized with the cam drive. If a color change (or, for that matter, any other kind of substitution of one thread for another) is to be carried out within a course, a second thread guide must be activated in place of the first one; the change from one thread guide to another, however, creates problems inasmuch as the two trailing thread portions overlap for a considerable distance so that the two threads are simultaneously present in a succession of loops forming a transition zone between two differently colored areas of the pattern. A sharp boundary between these areas is therefore difficult to achieve, especially in high-speed machines in which the operator cannot manually intervene to prevent the simultaneous laying-in of two threads.

OBJECT OF THE INVENTION

The object of my present invention, accordingly, is to provide an improved thread-guiding mechanism for such a knitting machine which obviates this drawback and enables the production of inlay-type patterns with precise zonal boundaries.

SUMMARY OF THE INVENTION

I realize this object, in accordance with my present invention, by mounting each thread guide on a respective slide on which it may assume either of two positions that are relatively offset in the direction of slide displacement, one of these positions being thus more advanced than the other as seen in that direction. When the slide is entrained by the transport mechanism along suitable support means, such as a horizontal guide bar, over a path which is limited by two associated end stops to a fraction of a course, the thread guide is in this advanced position and successively presents a trailing thread to a corresponding number of needles constituting less than all the active needles of the machine. As the slide approaches one of the associated stops at the end of its path, the thread guide is switched over into its alternate position so as to remove its thread from the reach of needles engaging the thread of another slide starting just then on a continuation of that path. During the following machine cycle, when the direction of movement of the slides and their sequence of activation is reversed, the switched thread guide is already in the proper position for the knitting of another course.

Advantageously, the thread guide is pivotally mounted on its slide so as to swing symmetrically about a line which is perpendicular to the direction of slide displacement. The switchover may be accomplished by a pair of oppositely extending feelers coupled with the thread guide, each feeler being engageable with one of the two associated end stops. During the displacement of an activated slide, the thread guide thereof may be retained in its leading position by suitable indexing means.

BRIEF DESCRIPTION OF THE DRAWING

The above and other features of my invention will now be described in detail with reference to the accompanying drawing in which.

SPECIFIC DESCRIPTION

Figures 3, 4:
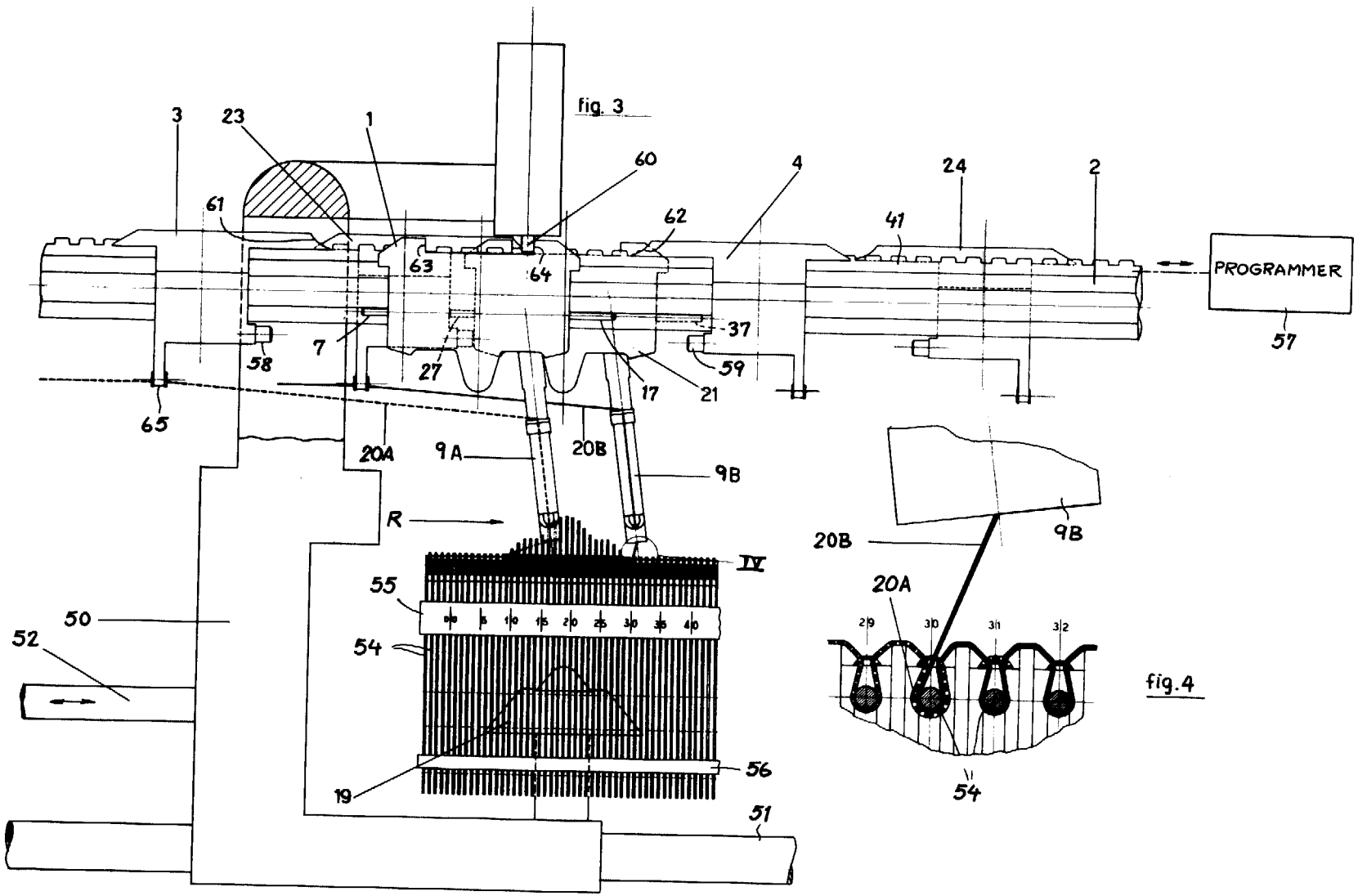
FIG. 3 is a more complete view of my improved thread-guiding mechanism, showing two slides with respective thread guides.
FIG. 4 is an enlarged view of a detail encompassed in a zone IV of FIG. 3.

Reference will first be made to FIG. 3 showing the principal parts of an otherwise conventional flat-bed knitting machine embodying my invention. The machine comprises a york-shaped carriage 50 whose dependent legs are slidably guided on a pair of parallel rods 51 and which is reciprocated along these rods by a nonillustrated drive mechanism via a link 52. Carriage 50 entrains a pair of cams 19 (only one shown) in a symmetrical double needle bed 53, FIG. 7, on which a multiplicity of latch needles 54 are movably guided as is well known per se. The needles are retained in their guide grooves by strips 55, bearing numerical markings which identify the several needle positions corresponding to the wales of the fabric, and are under downward tension from nonillustrated springs held by another pair of inserted strips 56.

Carriage 50 embraces a set of parallel horizontal guide bars 2, 102, 202, 302 (FIG. 7) of which only the bar 2 is visible in FIG. 3. Each bar forms a pair of lateral tracks for two independently displaceable slides designated 1 and 121 in the case of guide bar 2, 101 and 21 in the case of guide bar 102, 201 and 321 in the case of guide bar 202, and 301 and 221 in the case of guide bar 302. Only the slides 1 and 21 have been illustrated in FIG. 3.

Figure 7:
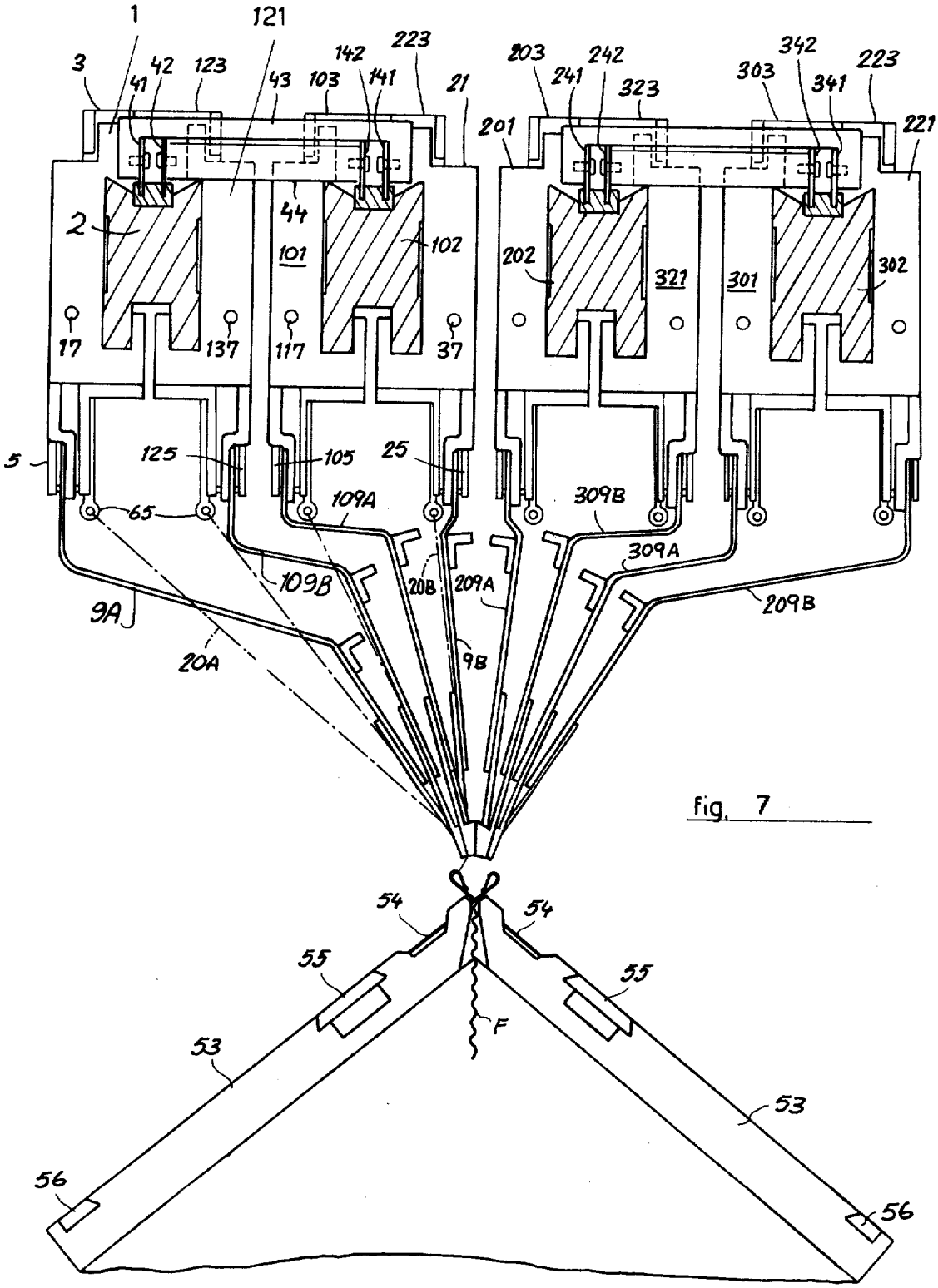
FIG. 7 is an end-elevational view of the mechanism, showing eight thread guides on respective slides.

Slide 1 co-operates with a pair of adjustable end stops 3 and 4 on bar 2, the corresponding stops for slide 21 having been designated 23 and 24. In FIG. 7 the counterparts of left-hand stops 3 and 23 (FIG. 3) have been designated 103, 203, 303 for bars 101, 201, 301 and 123, 223, 323 for bars 121, 221 and 321. These stops are shiftable, in a manner more fully described hereinafter, under the control of a Jacquard-type programmer 57 with the aid of racks 41, 42 slidably guided on bar 2 and similar racks 141, 241, 341 and 142, 242, 342 on the other bars. The stops have bumpers 58, 59 contacting the associated slide in its respective limiting positions in which, furthermore, a lug 60 on carriage 50 encounters a ramp 61 and 62 on the corresponding end stop whereby the lug is cammed out of a working position in which it engages a shoulder 63 or 64 on the slide to entrain it in one or the other direction.

Each slide carries a respective thread guide designated 9A and 9B in the case of slides 1 and 21; FIG. 7 also shows thread guides 109A, 209A, 309A and 109B, 209B, 309B of the six remaining slides. Each thread guide is supplied with a distinctively colored thread from a nonillustrated spool, the thread passing through an eyelet 65 on the corresponding left-hand end stop 3, 23 etc. The threads fed to guides 9A and 9B have been designated 20A and 20B, respectively.

Figure 1:
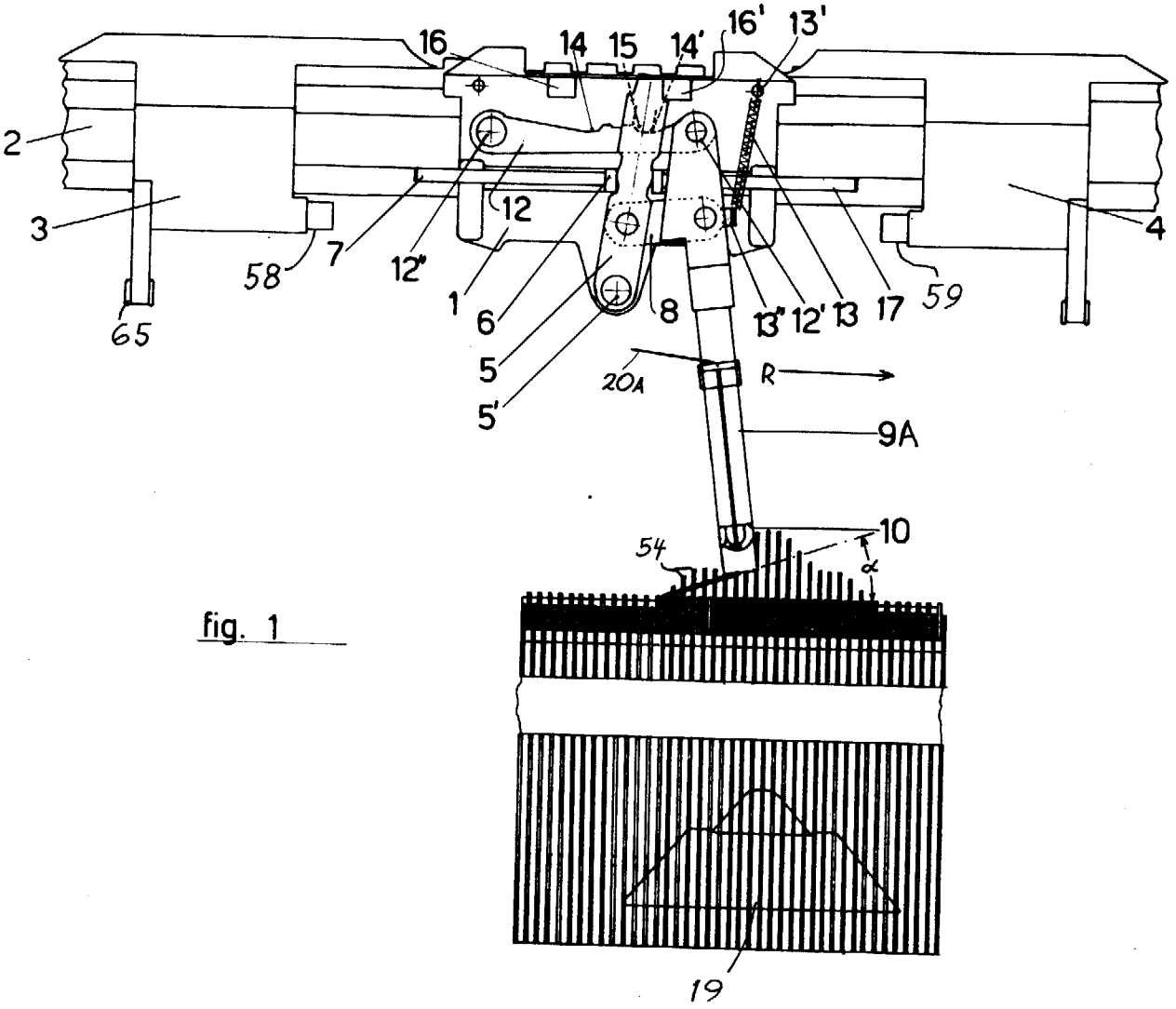
FIG. 1 is a somewhat diagrammatic elevational view of a thread guide and a slide forming part of a mechanism embodying my invention.
Figure 2:
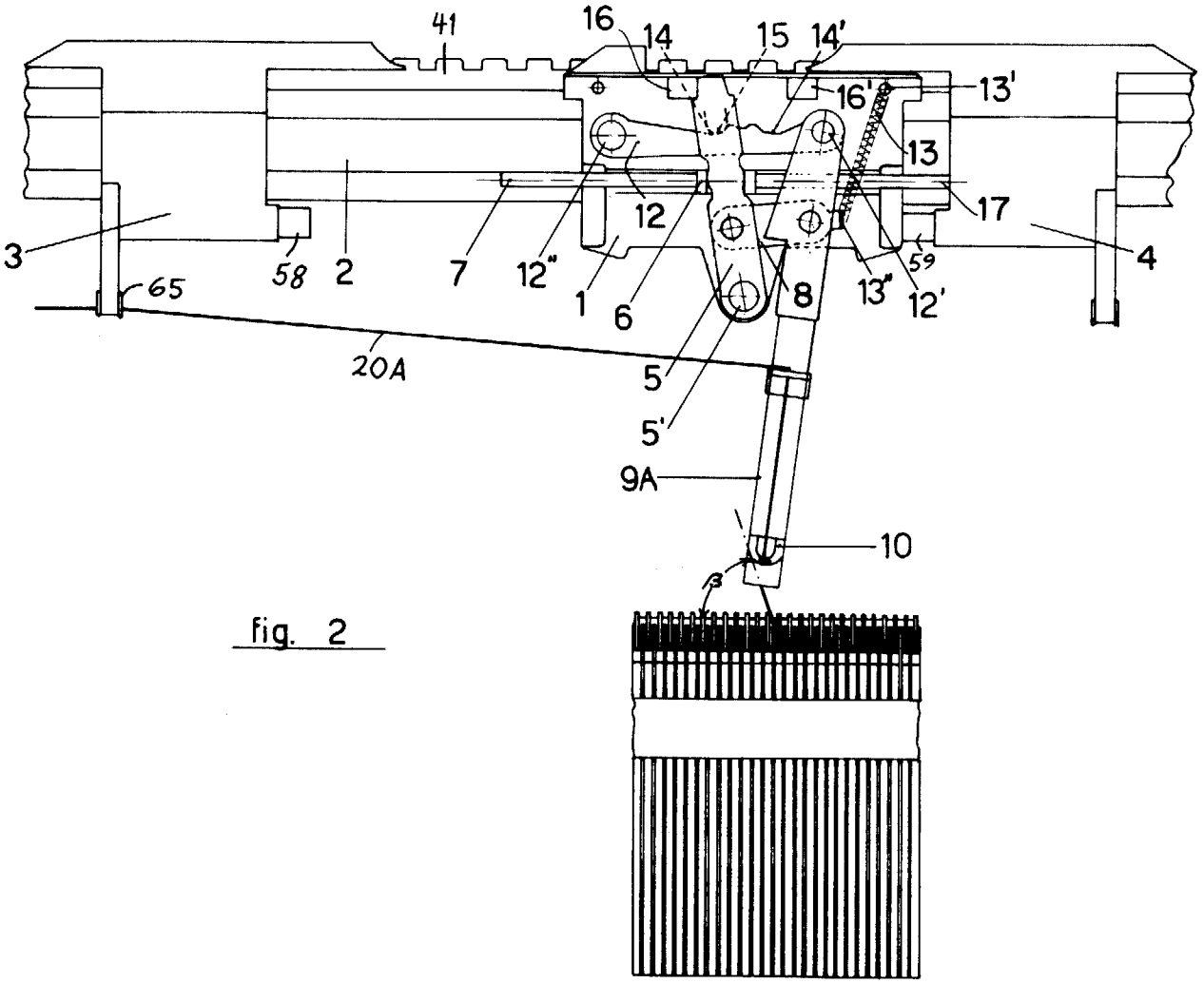
FIG. 2 is a view similar to FIG. 1, showing the thread-guiding mechanism in an alternate position.

In accordance with an important feature of my invention, each thread guide is swingably mounted on its slide as particularly illustrated for the guide 9A in FIGS. 1 and 2. Thread guide 9A is connected by a pivot pin 12', acting as a floating fulcrum, to a free end of an arm 12 which is pivoted to the slide at 12"; the thread guide can oscillate between two symmetrical positions respectively illustrated in FIGS. 1 and 2. This oscillation is controlled by a lever 5, pivoted to slide 1 at 5', which is coupled with the thread guide by an articulated link 8 attached at 13" to a contractile spring 13 anchored at 13' to the body of the slide. Lever 5 carries a lug 15 engaging in either of two notches 14, 14' of arm 12 as the latter is biased counterclockwise about its fulcrum 12" by the spring 13, thereby indexing the thread guide 9A in either of its two symmetrically opposite positions. The swing of lever 5 is limited by two abutments 16 and 16' rigid with slide 1.

Lever 5 is bracketed by a fork 6 which is rigid with a pair of rod-shaped feelers 7 and 17 extending in opposite directions, i.e. toward end stops 3 and 4, respectively. When the slide 1 is being entrained to the right as indicated by an arrow R in FIG. 1, thread guide 9A is tilted forwardly in the same direction whereby a trailing portion of its thread, inclined at a small angle $\alpha$ to the horizontal direction of motion, is laid into the extended latch needles 54 which are being retracted by the cam 19 as the tip 10 of the thread guide moves past them. As the slide 1 approaches the right-hand end stop 4, feeler 17 is repressed and swings the lever 5 counterclockwise about its pivot 5', dislodging the lug 15 from the notch 14' and moving the thread guide 9A in a clockwise sense into its trailing position shown in FIG. 2. With the slide 1 now stationary, the thread 20A has a leading portion (as viewed in the direction of arrow R) including a large angle $\beta$ with the line of slide motion. This puts the thread 20A out of reach of those needles which are active during the remainder of the machine cycle.

In the left-hand portion of mirror-symmetrical FIG. 7, counterparts of feeler 17 have been designated 37, 117 and 137 for slides 21, 101 and 121, respectively. The corresponding switchover levers are numbered 25, 105 and 125.

When the movement of the slide 1 is reversed in the next cycle, thread guide 9A is again in leading position whereby a trailing portion of thread 20A is engaged by the working needles until the slide reaches the left-hand stop 3 and the feeler 7 restores the guide to its previous position illustrated in FIG. 1.

FIGS. 3 – 6 show the position of thread guides 9A and 9B in two different phases of a rightward stroke of carriage 50. In FIGS. 3 and 4 the slide 21 is in contact with its left-hand or rear stop 23 against which it has come to rest during the preceding leftward travel. Stationary thread guide 9B, therefore, points to the right in the position last reached in which its thread 20B became engaged by needle No. 30 as best seen in FIG. 4. For the sake of clarity, this thread 20B has been shown in FIGS. 3 – 6 in solid lines whereas thread 20A has been shown dotted. FIG. 4 also indicates that thread 20A, during the preceding leftward stroke, started at needle No. 31 which is the one next to the needle last engaged by thread 20B.

Figures 5, 6:
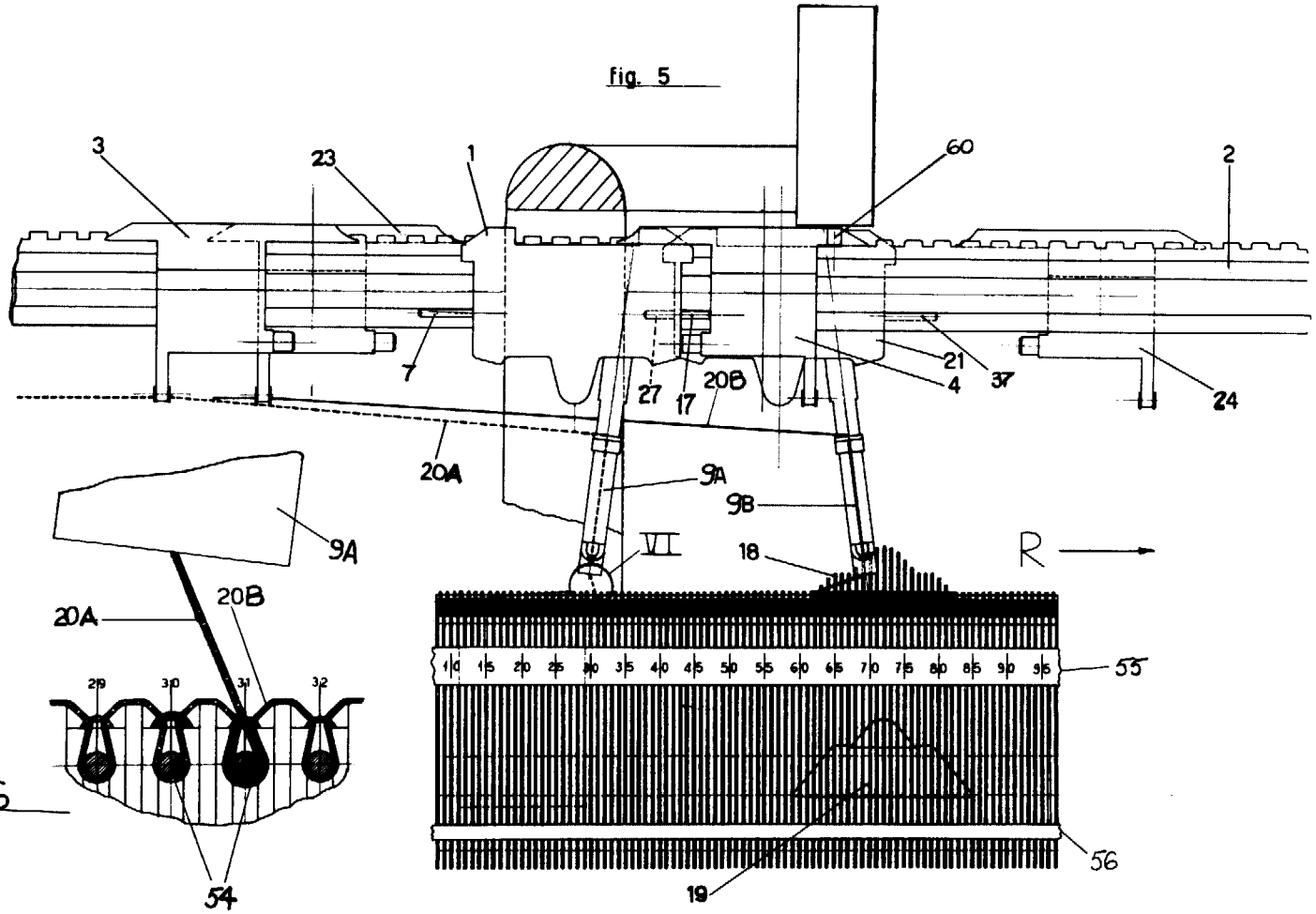
FIG. 5 is a view similar to FIG. 3, showing the mechanism in another operating phase.
FIG. 6 is an enlarged view of a detail encompassed in a zone VI of FIG. 5.

If the zonal boundary between two areas of the colors of threads 20A and 20B is to be vertical, i.e. parallel to the lateral edge of a fabric F growing between the two halves of needle bed 53 (FIG. 7), the position of stops 4 and 23 does not change between courses so that slide 1 again comes to rest against its front stop 4 at an instant when the thread 20A is engaged by needle No. 31. The thread guide 9A is now switched over into its alternate position, shown in FIGS. 5 and 6, so that none of the needles to the right of No. 31 can intercept the thread 20A. At this point, lug 60 of carriage 50 begins to entrain the slide 21 whereby thread guide 9B, still tilting forward as seen in FIG. 5, lays the thread 20B into needle No. 31 and other needles to the right thereof until the slide 21 reaches the end of its run as determined by the position of stop 24. Thread guide 9B is then switched back into its alternate position in which it remains until the next course while another such thread guide (e.g. guide 109A in FIG. 7) continues or completes the course.

The spacing of the two shoulders 63, 64 (FIG. 3) of each slide is so chosen that, upon the reversal of the slide motion, the steep angle $\beta$ initially included between the trailing thread portion and the upper edge of the needle bed is reduced to its previous magnitude $\alpha$ in time for engagement of that thread portion by the descending hook of the next needle in the direction of motion, i.e. needle No. 30 in the case of the leftward moving slide 1 under the conditions assumed above.

Figure 8:
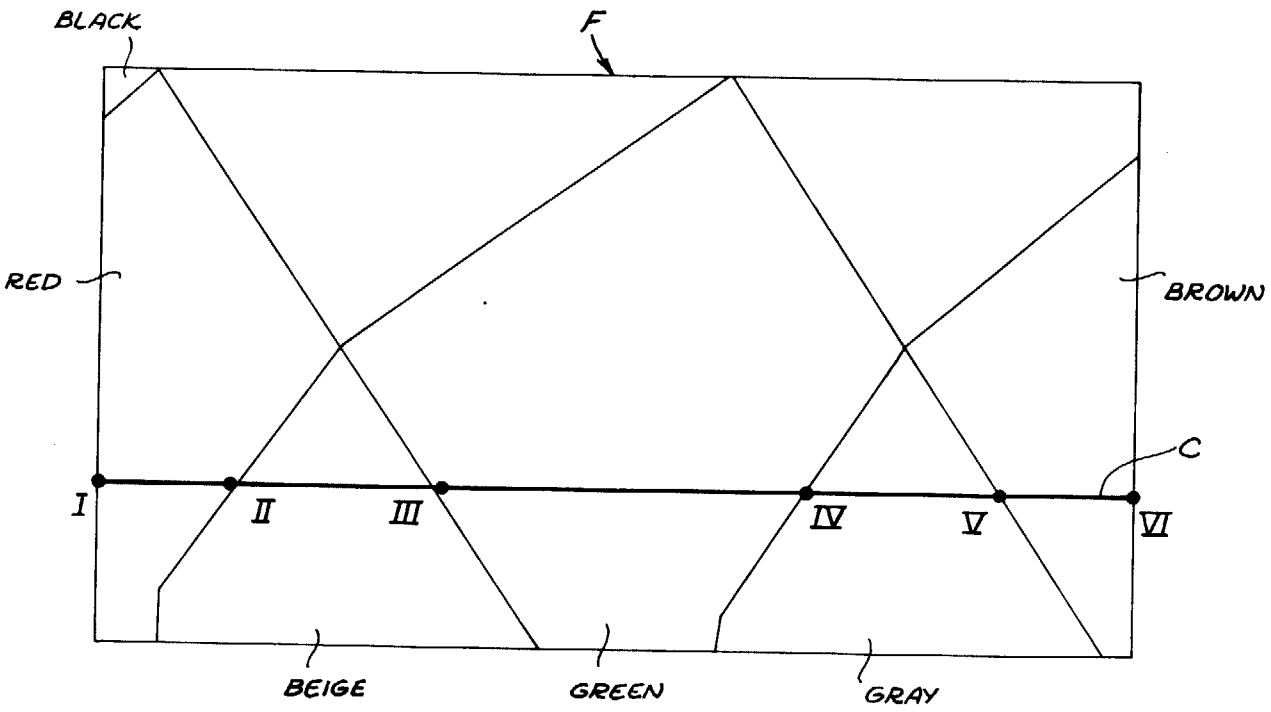
FIG. 8 illustrates part of a multicolor inlay-type pattern to be produced by the mechanism of FIGS. 1 - 7.

It will thus be seen that only two needles 54, here Nos. 30 and 31, coact in one course with two overlapping threads such as 20A and 20B along a zonal boundary which is, therefore, sharply defined on the resulting pattern. A fabric F bearing such a pattern has been illustrated in FIG. 8 showing red, beige, green, gray and brown areas formed on a course C by five different threads with the aid of as many different thread guides and slides, e.g. the guides 9A, 9B, 109A, 109B and 209A of FIG. 7. The starting and stopping of a slide along that course occurs at any of six points I – VI; edge points I and VI are fixed stop positions whereas intermediate points II – V indicate a changeover from one thread to another, these latter points being transversely shiftable by one, two or three needle positions or wales at a time through a readjustment of the corresponding stops by the programmer 57 of FIG. 3. Naturally, the end of the run of one slide must invariably coincide with the beginning of the run of the next slide (with a limited overlap of, say, two loops as discussed above, required for continuity) so that the corresponding stops are to be simultaneously displaced. It will also be noted that, in the pattern of FIG. 8, the zonal boundaries passing through points II and IV are parallel to each other, as are the boundaries passing through points III and V. This means that the stops defining these zonal boundaries can all be displaced in unison which simplifies their control mechanism.

Let us assume that thread guides 9A, 9B, 109A, 109B and 209A in FIG. 7 carry red, beige, green, gray and brown yarns, respectively. In knitting a row of loops such as the course C from left to right in the pattern of FIG. 8, slides 1, 21, 101, 121 and 201 will have to be successively entrained over the paths marked by the points I - VI. Thus, slide 1 moves from point I to point II, slide 21 advances from point II to point III, slide 101 covers the stretch between points III and IV, slide 121 continues the course between points IV and V, and slide 201 traverses the final section between points V and VI. Since points II and IV preserve the same distance in all cycles, the front stop 4 of slide 1 and the corresponding front stop of slide 101 must be shifted simultaneously with the rear stop 23 of slide 21 and the corresponding stop 123 of slide 121. Also, the constant spacing between points III and V calls for a simultaneous shifting of the front stop 24 of slide 21, the corresponding stop of slide 121 and the rear stops 103 and 203 of slides 101 and 201.

In FIG. 7 the racks 41 and 141 are shown rigidly interconnected by a bridge 43, racks 42 and 142 being similarly interconnected by a strap 44. Analogous links are provided for racks 241, 341 and 242, 342. With stop 3 disconnected from both racks 41, 42 of the associated bar 2, stops 4 and 23 may be respectively connected to the interconnected racks 41 and 141 along with stop 123 and the nonillustrated mate of stop 103. Similarly, stops 24 and 103 may be connected to rack 142, rack 42 being joined to the mate of stop 123. Racks 242, for example, may be connected to stop 203, this rack being driven by the programmer in synchronism with racks 42 and 142; the front stop of slide 201, i.e. the mate of stop 203, is decoupled from racks 241, 242 and, like stop 3, is stationary.

Through a selective coupling and decoupling of end stops to and from either rack of a corresponding guide bar, e.g. by electromagnetic grippers under the control of the programmer, I can bring additional colors into the pattern and/or eliminate colors previously used. Thus, FIG. 8 shows at lower left the beginning of a new color area (black) produced by the activation of a formerly unused thread guide even as the thread guide 209A, carrying the brown yarn, is deactivated as depicted in the Figure at lower right.

FIG. 7 further shows that the tips of thread guides 109A and 109B, whose paths overlap like those of guides 9A and 9B, are closely juxtaposed just above needle bed 53 and are aligned with the tips of guides 9A and 9B from which they always remain longitudinally separated. In an analogous manner, the tips of thread guides 209A and 209B meet directly behind the tips of the converging thread guides 309A and 309B.

The double needle bed 53 of FIG. 7 could also be replaced by a single bed carrying only one set of latch needles 54. Other modifications, including changes in the control mechanism for the shifting of the end stops, will be readily apparent to persons skilled in the art.

I claim:

1. In a knitting machine provided with a flat needle bed carrying a multiplicity of knitting needles, feed means for supplying thread to said needles, and reciprocating drive means for successively displacing an active group of said needles to draw the supplied thread into a row of loops during each machine cycle, the improvement wherein said feed means comprises:

a plurality of slides each provided with a thread guide;

support means enabling the displacement of said slides adjacent one another across said needle bed with entrainment of respective threads past said needles, each thread guide being movable on its slide between two positions relatively offset in the direction of slide displacement;

a pair of end stops for each slide;

transport means coupled with said drive means for entraining each slide during a machine cycle along a path limited by said end stops to extend over only a fraction of said row of loops, with presentation of the corresponding thread to less than all the needles of said group, the distances traveled by said slides complementing one another with limited overlap whereby said row of loops is formed from a succession of different threads; and switchover means on each slide controlled by the associated end stops for moving the thread guide thereof from one of said positions, advanced in the direction of slide displacement, to the other of said positions at the end of its path, with resulting removal of the corresponding thread from the reach of needles engaging the thread of another slide starting on a continuation of said path.

2. The improvement defined in claim 1 wherein said switchover means comprises a pair of oppositely extending feelers on each slide coupled with the thread guide thereof, said feelers being respectively engageable with the associated end stops.

3. The improvement defined in claim 1 wherein each thread guide is pivotally mounted on the associated slide for swinging about a line perpendicular to the direction of slide displacement, said positions lying symmetrically on opposite sides of said line.

4. The improvement defined in claim 3 wherein each slide is provided with indexing means for releasably arresting the associated thread guide in either of said positions.

5. The improvement defined in claim 4 wherein said indexing means includes a spring-loaded arm and a lever pivoted to the slide, said arm and said lever being provided with coacting formations, the thread guide being fulcrumed on a free end of said arm, said lever being positively connected with said feelers and articulatedly linked with the thread guide.

6. The improvement defined in claim 3 wherein said transport means comprises a reciprocable carriage common to all slides, each slide being provided with a pair of shoulders spaced apart in the direction of displacement and engageable by a projection on the carriage for entrainment in opposite directions.

7. The improvement defined in claim 1 wherein said end stops are adjustably mounted on said support means for selective displacement after any machine cycle.

8. The improvement defined in claim 7 wherein said support means comprises a plurality of horizontal bars each forming tracks for a pair of said slides on opposite sides thereof, each bar being provided with at least two independently movable control members linked with the end stops mounted thereon for changing the path limits of the associated slides.

9. The improvement defined in claim 8 wherein the control members of end stops associated with consecutively displaceable slides are interconnected for joint adjustment.

10. The improvement defined in claim 1 wherein one end stop of each pair is provided with an eye for feeding the thread to the associated thread guide.

* * * * *